US005503413A

United States Patent [19]

Belogour

[11] Patent Number: 5,503,413

[45] Date of Patent: Apr. 2, 1996

[54] IN-LINE ROLLER SKATES WITH SUSPENSION

[75] Inventor: Pavel Belogour, 76 Clearway St. #3, Boston, Mass. 02115

[73] Assignee: Pavel Belogour, Boston, Mass.

[21] Appl. No.: 330,449

[22] Filed: Oct. 31, 1994

[51] Int. Cl.[6] ..... A63C 17/04

[52] U.S. Cl. ..... 280/11.22; 280/11.27; 280/11.28

[58] Field of Search ..... 280/11.19, 11.22, 280/11.23, 11.27, 11.28, 11.31

[56] References Cited

U.S. PATENT DOCUMENTS

| | | | |
|---|---|---|---|
| 301,522 | 7/1884 | Richardson | 280/11.28 |
| 302,503 | 7/1884 | Lincoln | 280/11.28 |
| 326,224 | 9/1885 | Kefuss | 280/11.28 |
| 852,570 | 5/1907 | Miller | 280/11.28 |
| 938,168 | 10/1909 | Nolan | 280/7.13 |
| 1,603,588 | 4/1925 | Eberle | 280/7.13 |
| 4,351,538 | 5/1980 | Berta | 280/11.26 |
| 4,382,605 | 5/1983 | Hegna | 280/7.13 |
| 4,402,521 | 9/1983 | Mongeon | 280/11.28 |
| 4,915,399 | 5/1988 | Marandel | 280/11.28 |
| 5,257,793 | 11/1993 | Fortin | 280/11.22 |

FOREIGN PATENT DOCUMENTS

| | | | |
|---|---|---|---|
| 2586619 | 3/1987 | France | 280/11.27 |
| 233545 | 4/1911 | Germany . | |
| 4209415 | 11/1992 | Germany | 280/11.23 |
| 9312846 | 7/1993 | WIPO | 280/11.22 |
| 9312847 | 7/1993 | WIPO | 280/11.28 |
| 9314840 | 8/1993 | WIPO | 280/11.22 |

*Primary Examiner*—Margaret A. Focarino
*Assistant Examiner*—Min S. Yu

[57] ABSTRACT

The in-line roller skate includes a shoe (10) having a sole plate (12), a toe attachment (14) and a heel attachment (16) which is secured to the sole plate (12). A suspension system (18) is secured at one end thereof on the central part of the rear axle (40) of the wheel frame (44). The opposite end thereof is guided by an extended pin (20) through the centering cut bore (38) which is located inside the heel attachment (16). This allows vertical movement of the shoe (10) in that the spring (15) is supported by the cavity washers (22) located on the top and bottom of the extended pin (20). Two parallel flanges (30) of the toe attachment (14) are connected to the wheel frame flanges (28) by a pivoting axle (42) which allow vertical clearance movements of the extended pin (20) of the suspension system (18).

8 Claims, 6 Drawing Sheets

IN-LINE ROLLER SKATES WITH SUSPENSION

BACKGROUND OF THE INVENTION

1. Field of the Invention

This invention relates to in-line roller skates, the type equipped with in-line wheels, having a suspension system on a rear part of the skates that provides both self-propelled and shock absorbing actions.

2. Description of the Prior Art

Presently all models of in-line roller skates have a sole chassis with wheels that are permanently secured to the shoe. The chassis is the heart of the roller skate connecting a skater with the surface of the road. All present in-line models do not recognize the loss of untapped energy of a skater. Prior art also fails to provide damping and suspension functions when the roller skate runs upon an obstacle. Therefore when a person uses in-line roller skates on an uneven surface he or she feels uncomfortable shocks and vibrations. These shocks and vibrations also lead to a significant loss of speed.

Thereafter, inventors created several types of devices for roller skates in order to eliminate these inconveniences by introducing a suspension device at the level of the roller skates' axles. U.S. Pat. Nos. 4,915,399 and 5,029,882 to Marandel (1988) and (1991) respectively disclose suspension devices to prevent the roller skater (as much as possible) from being subjected to the shocks and vibrations resulting from the unevenness of the skating surface. However, this invention does not relate to the in-line roller skates. In prior art the shock absorbing device is secured to the front and rear running undercarriages equipped with the tow wheels which are located differently in in-line roller skates. The prior inventions having suspension systems, refer only to roller skates which differ significantly from in-line roller skates, the latter having in-line wheels. Prior art also fails to use the availability of a hidden and untapped energy of a released spring action, thus limiting attainable speeds of the skater. Finally, prior arts include the location of a suspension system in a manner that is less efficient for the user and less cost effective for the manufacturer.

Canadian patent 4,351,538 to Berta (1980) shows a spring assisted roller skate which contains a spring that provides a shock absorbing effect. This invention having only two wheels, however, does not provide stable and convenient operating conditions. It is also slow in terms of attainable speeds.

As we can see, all heretofore inventions do not relate to the in-line roller skates having more than two wheels lining up one after another. Also, all heretofore inventions known suffer from a number of disadvantages:

(a) Presently popular in-line roller skates do not provide damping and suspension functions when the skates run upon obstacles and uneven surfaces.

(b) Past suspension system inventions do not include a self-propelling action feature.

(c) The use of more than one shock absorbing suspension system is not necessary and adds cost to the manufacturer. One efficient shock absorbing suspension system can be used that simultaneously provides a self-propelling action with the shock absorbing system thus minimizing parts but retaining maximum effects.

(d) The failure to use the untapped energy prohibits reaching the fully available speeds of the in-line roller skates which could easily be obtained using a self-propelled action system. This failure also leads to the quick exhaustion of a skater.

SUMMARY OF THE INVENTION

Accordingly, several objects and advantages of the suspension for in-line roller skates of the present invention are:

(a) to provide an in-line roller skate suspension system that offers a skater the ability to eliminate inconveniences of shocks and vibrations while running upon obstacles or uneven (b) to provide an in-line roller skate that fully uses untapped energy that is locked in a permanently fixed chassis to the shoe by using a self-propelling action effect via a suspension system;

(c) to provide an in-line roller skate that decreases exhaustion of a skater and adds more use and enjoyment for the skater.

Further objects and advantages are to provide an in-line roller skate which can be used easily and conveniently and which is relatively simple and inexpensive to manufacture in comparison to other suspension systems while providing a self-propelling action system. Another object and advantage is to provide an in-line roller skate that can simulate a cross country skiing effect if used with additional poles. This in-line roller skate system would therefore appeal not only to in-line roller skaters, but also to those who enjoy cross country skiing and who would like a viable alternative to the latter sport in the summer months. Still further objects and advantages will become apparent from a consideration of the ensuing description and drawings.

Accordingly, the reader will see that the suspension system of the self-propelled in-line roller skates can be used just as easily as conventional in-line roller skates but with much greater results. The suspension system of the self-propelled in-line roller skates will provide consistent conditions while a skater uses in-line roller skates on uneven surfaces. The invention of the suspension for in-line roller skates will save and use available energy of the skater and help him/her to reach higher speeds. Furthermore, the self-propelling in-line roller skates have additional advantages in that:

it eliminates inconveniences due to the shocks and vibrations of an uneven skating surface through a suspension system;

it provides the skater with a self-propelled action that uses the same energy the skater would use without the self-propelling mechanism to achieve higher speeds with less exertion;

it allows the manufacturer to produce an in-line roller skate that both self-propels and shock absorbs in one system thus comparatively reducing manufacturing costs if these features were separated into two different and dedicated systems;

it offers a product with a wider consumer appeal by improving on the effects and results of standard in-line roller skates for the interest of in-line roller skaters and by offering an alternative sport in the summer months for cross country skiers when used with additional poles.

Although the description above contains specification, these should not be construed as limiting the scope of the invention but as merely providing illustrations of some of the presently preferred embodiments of this invention.

Thus the scope of this invention should be determined by the appended claims and their legal equivalents, rather than by the examples given.

DESCRIPTION OF THE PREFERRED EMBODIMENTS

Figure 1:
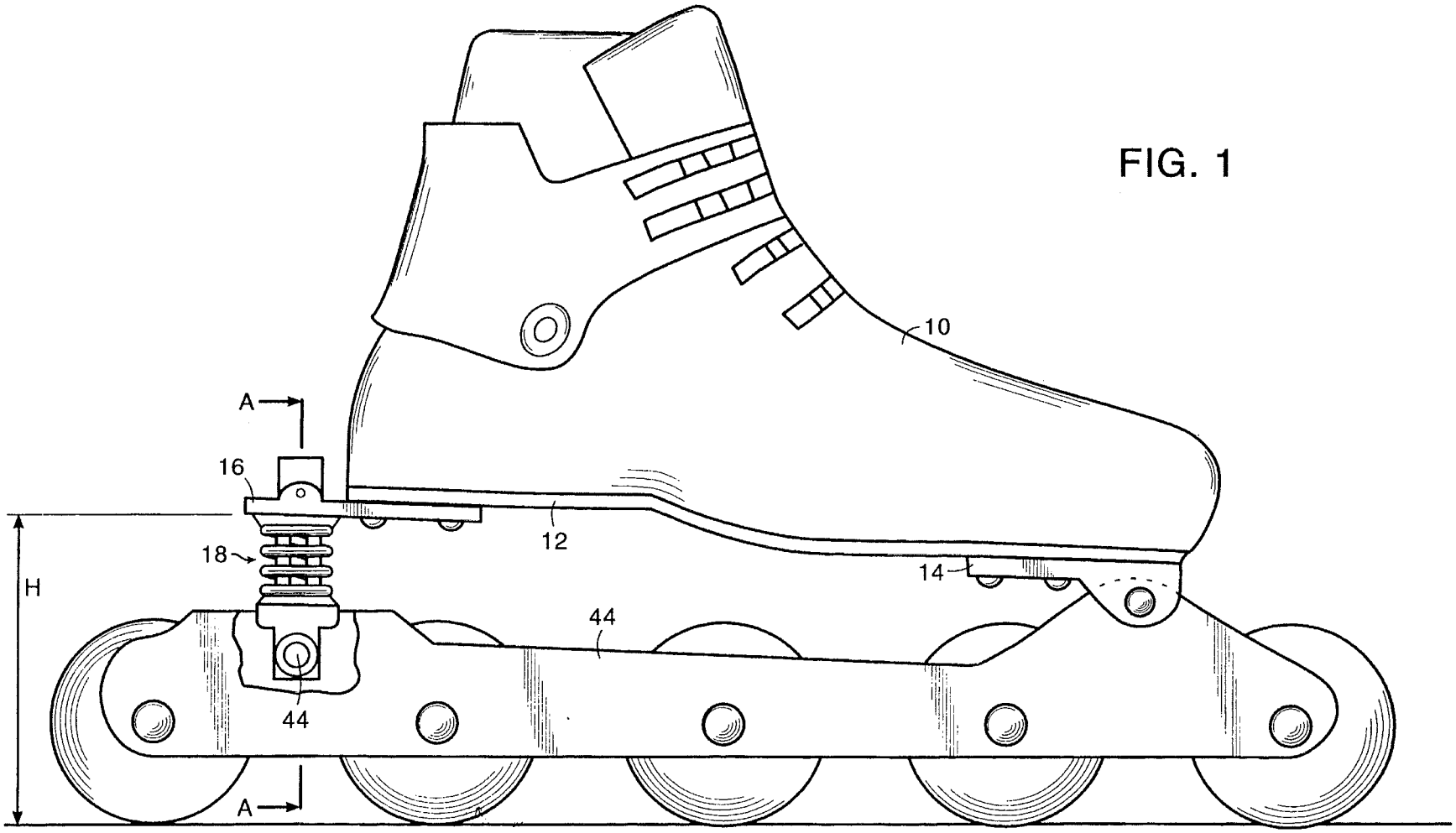
FIG. 1 shows a side elevational view on a reduced scale of the in-line roller skates according to the invention with the partially broken wheel frame.

The in-line roller skates represented in FIG. 1 is comprised of a shoe 10 fixed to a sole plate 12. A toe attachment 14 and a heel attachment 16 are secured to the sole plate 12. The skate further contains suspension system 18, the latter being secured at one end in the central part of the rear axle member 40 right to the wheel frame 44, and the other end being guided by a centering bore 38 (FIG. 3) that is located inside the heel attachment 16.

Figure 2:
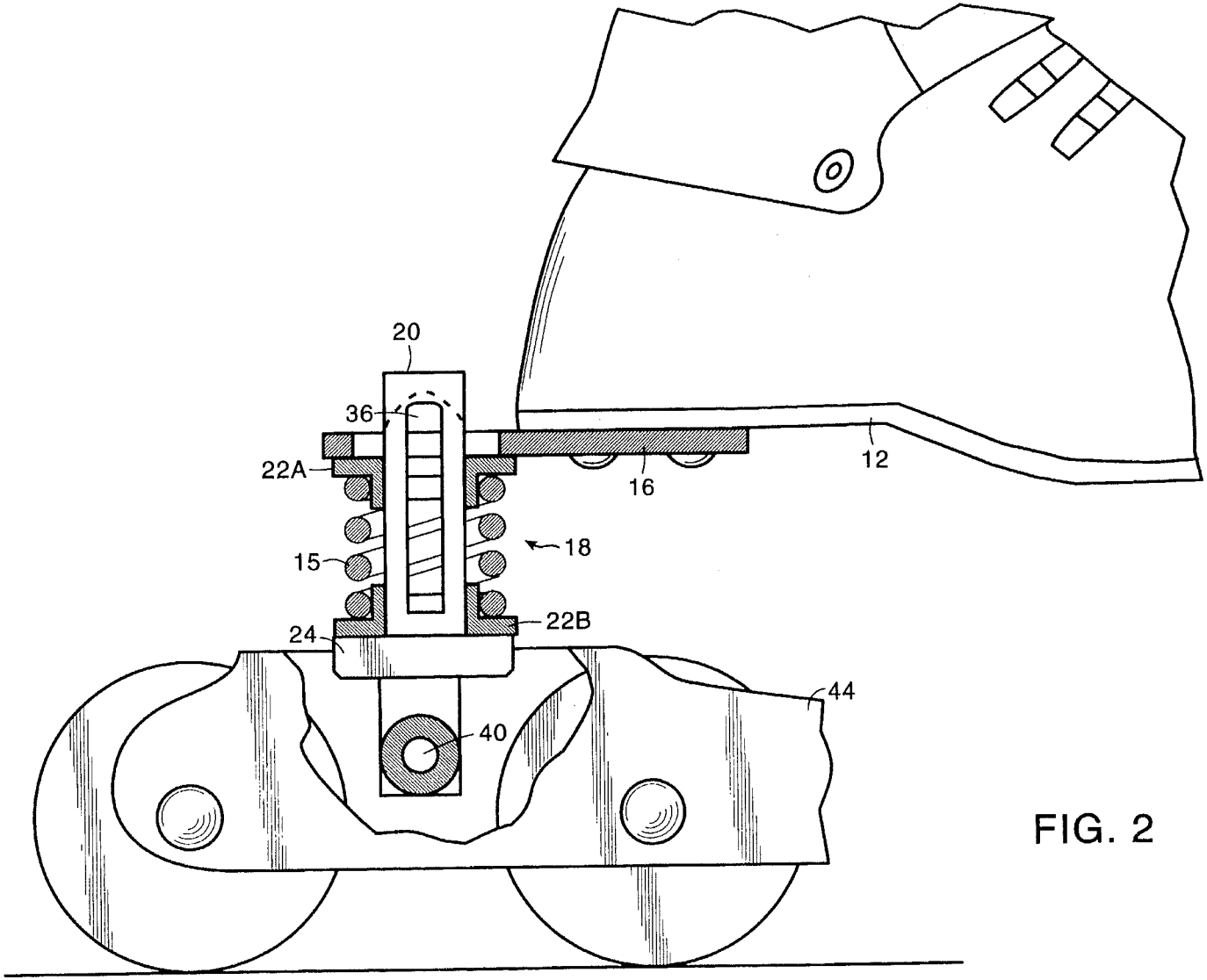
FIG. 2 shows at a large scale details of the part consisting the rear portion of the in-line rollers on a partial longitudinal section.

Referring to FIG. 2 it shows in detail suspension system 18, the latter being secured at one end in the central part of the rear axle member 40 right between the sides of the wheel frame 44 and the other end being guided by a centering bore 38 (FIG. 3) located inside the heel attachment 16 that is secured to a sole plate 12.

A suspension system 18 is composed of a spring 15 and a centering finger 24, the latter being secured at one end in the rear axle member 40, which is secured to the wheel frame 44, while the other end is extended by a pin 20 guided by the centering bore 38 (FIG. 3) of the heel attachment 16. The spring 15 being guided upward and downward by the outer surface of the top and bottom cavity washers **22*a*,22*b*** made of self-lubricating materials.

The stiffness of spring 15 is selected in accordance with the weight of the user of the skates. The extended pin 20 has a vertical cut through 36 for a bar pin 37 (FIG. 3) which readjusts the angle of the extended pin 20 during the full contraction of the spring.

Figure 3:
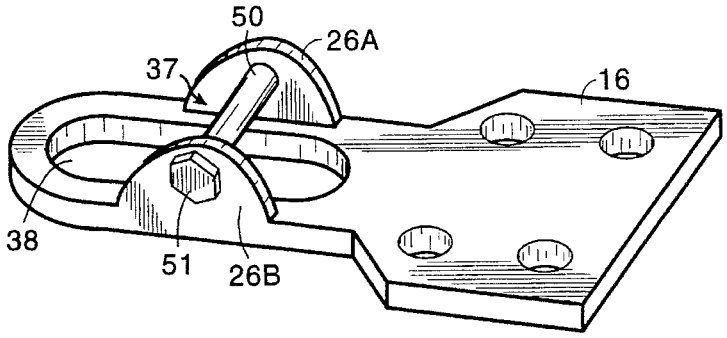
FIG. 3 shows a top isometric plan view illustration the detail of the heel attachment.

FIG. 3 illustrates the width of the centering bore 38 which is approximately equivalent to the diameter of the extended pin 20. The length of the centering bore 38 permits the extended pin 20 of the centering finger 24 to freely slide rearwardly away from the shoe 10 by 20 degrees while the spring 15 at the full compression and angle of the heel attachment 16 is changed.

The heel attachment 16 in FIG. 3 comprises of hinge bar flanges **26*a*, 26*b* for attaching bar pin 37 that goes through the cut of the extended pin 36 (FIG. 2) and adjusts the angle of the extended pin 20 approximately by 20 degrees, when spring 15 is at the full contraction. The bar pin is comprised of a bolt 50 and a nut 51. The centering bore 38 of the heel attachment 16 is designed to rigidly hold and otherwise secure any sideway movements of the extended pin 20 while permitting free up and down movements of the shoe 10**.

Figure 4:
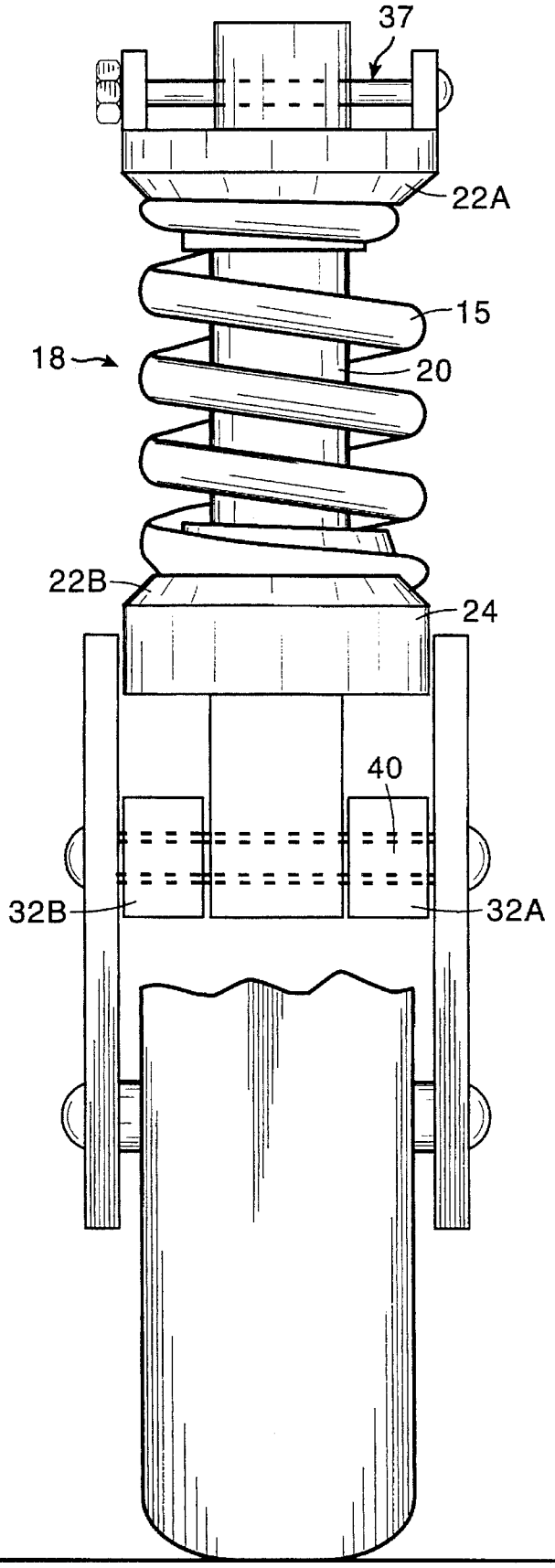
FIG. 4 shows at a large scale details of the part relating to the suspension system of the rear portion of the in-line rollers according to a cross section along line A—A of FIG. 1.

According to FIG. 4 the suspension system 18 is shown according to the cross section along line AA of FIG. 1. In this figure the centering washers **32*a*, 32*b* supporting by rear axle member 40 prevent side movements of the centering finger 24 to the left or to the right while during normal operation. The bar pin 37 coming through the cut of the extended pin 36 (FIG. 2) helps to move the extended pin 20 while the spring 15** is fully compressed under the weight of the skater.

The top and bottom cavity washers **22*a*, 22*b*, which are self-lubricated in FIG. 4 provide support for the spring 15 and prevent sidemovements of the spring. The width of the top part of the top and bottom washers 22*a*, 22*b* is equivalent to the diameter of spring 15**.

Figure 6:
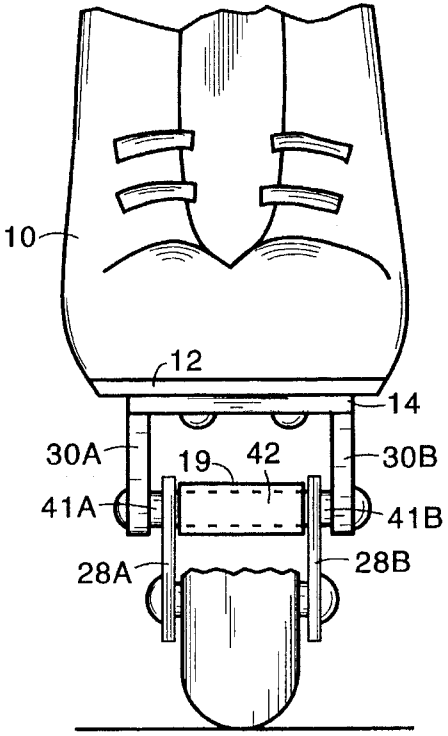
FIG. 6 shows a front elevational view partially blown away and showing the principal or manner in which the wheel frame is attached to the toe attachment.
Figure 5:
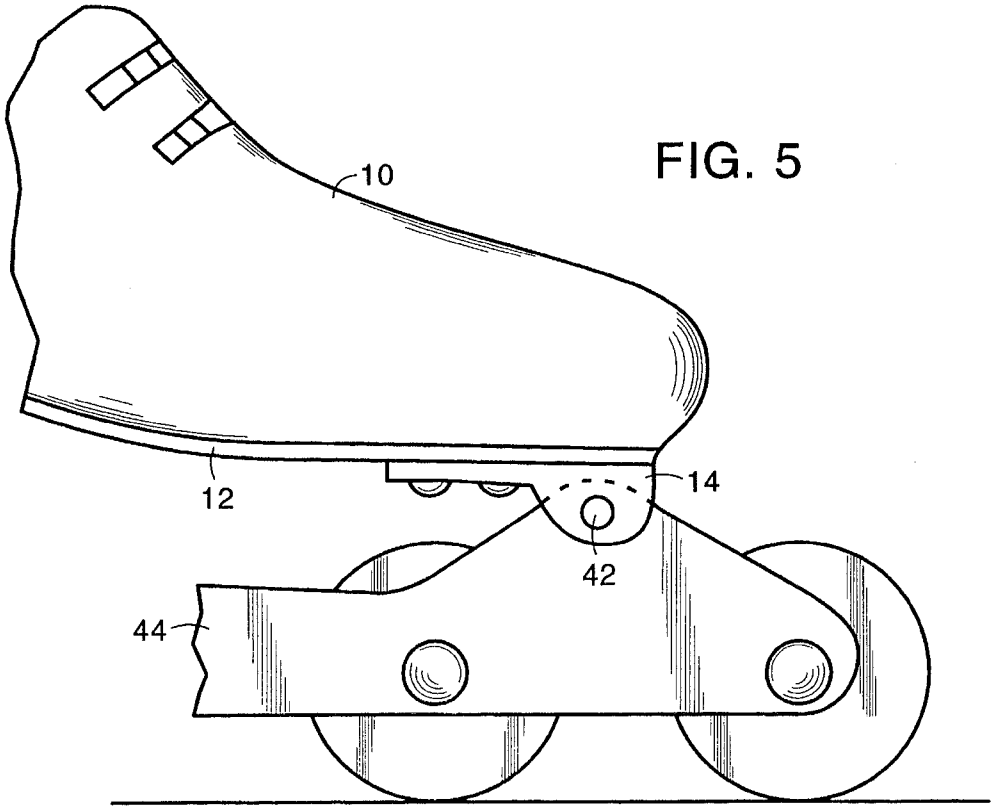
FIG. 5 shows a side view at a large scale of the toe attachment to the blade of the in-line skates.

Attention is now directed to FIGS. 5,6, where toe attachment 14 is connected to the sole plate 12 and the shoe 10, on one end and to the wheel frame 44 on the other. The toe attachment 14 consists of flanges **30*a*, 30*b* that are connected to the flanges of the wheel frame 28*a*, 28*b* through the pivoting axle 42. A centering barrel 19 of the pivoting axle 42 is located between flange members 28*a*, 28*b* of the wheel frame 44, prevent wheel frame from sliding and bending. In FIG. 6 pivoting axle washers 41*a*, 41*b* are in use to prevent direct friction of the flanges of the wheel frame 28*a*, 28*b* and toe attachment flanges 30*a*, 30*b***.

Figure 7:
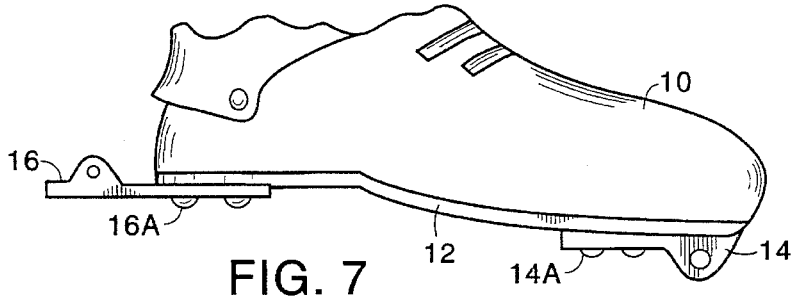
FIG. 7 shows a partial side elevational view and illustrating the details of the heel and the toe attachment means.
Figure 8:
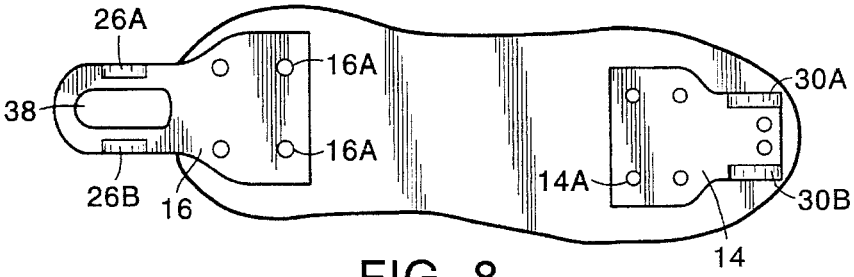
FIG. 8 shows a bottom plan view of the shoe portion the details of the toe and heel attachment means.

With continued attention to FIGS. 7,8 it will be observed that the heel attachment 16 includes hinge bar flanges **26*a*, 26*b* and centering bore 38. It will be observed that the toe attachment 16 consists of flange members 30*a*, 30*b*. Coupling means such as rivets 14*a* and 16*a* are provided for securing heel attachment 16 and toe attachment 14 to the sole plate 12 of the shoe 10**.

Figure 9:
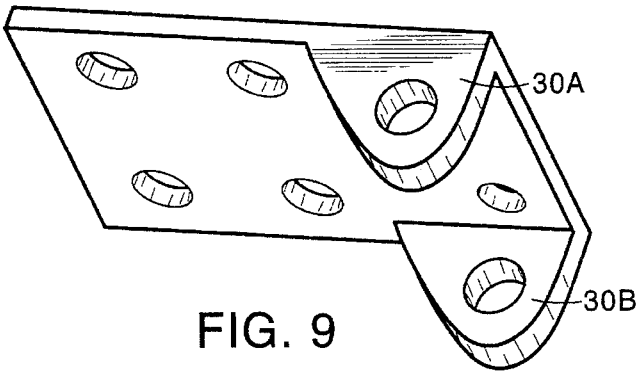
FIG. 9 shows an isometric plan view of a large scale illustrating the detail of the toe attachment.

The toe attachment 14 FIG. 9 comprises of toe flange members **30*a*, 30*b* that are overlap wheel frame flanges 28*a*, 28*b* and support the wheel frame 44** from sliding.

From the description above, a number of advantages of my self-propelled in-line roller skates become apparent:

(a) With the use of in-line roller skates having a self-propelling action, skaters will use less energy to more easily achieve higher speeds while experiencing greater comfort and enjoyment.

(b) The use of this in-line roller skate invention offers not only a self-propelling action but also a suspension system which smoothes the effects of skating over uneven surfaces or obstacles.

(c) The placement and design of my in-line roller skates offer a combination suspension-self-propelling system with minimal and efficient features thus keeping manufacturing costs lower than if these were addressed in two separate systems.

The operationg mode of the suspension system is as follows:

FIG. 1 illustrates the roller skate in its relaxed condition during which no load is applied to the top of the skate. It should be noted that during such condition spring 15 is fully extended and under slight compression contacting cavity washers 22*a*, 22*b* (FIG. 2). Also to be noted the spring centering finger 24 is slightly tilted from the vertical slightly rearwardly. In the relaxed condition the distance H between the top of the sole plate 12 and the ground is at the maximum.

Figure 10:
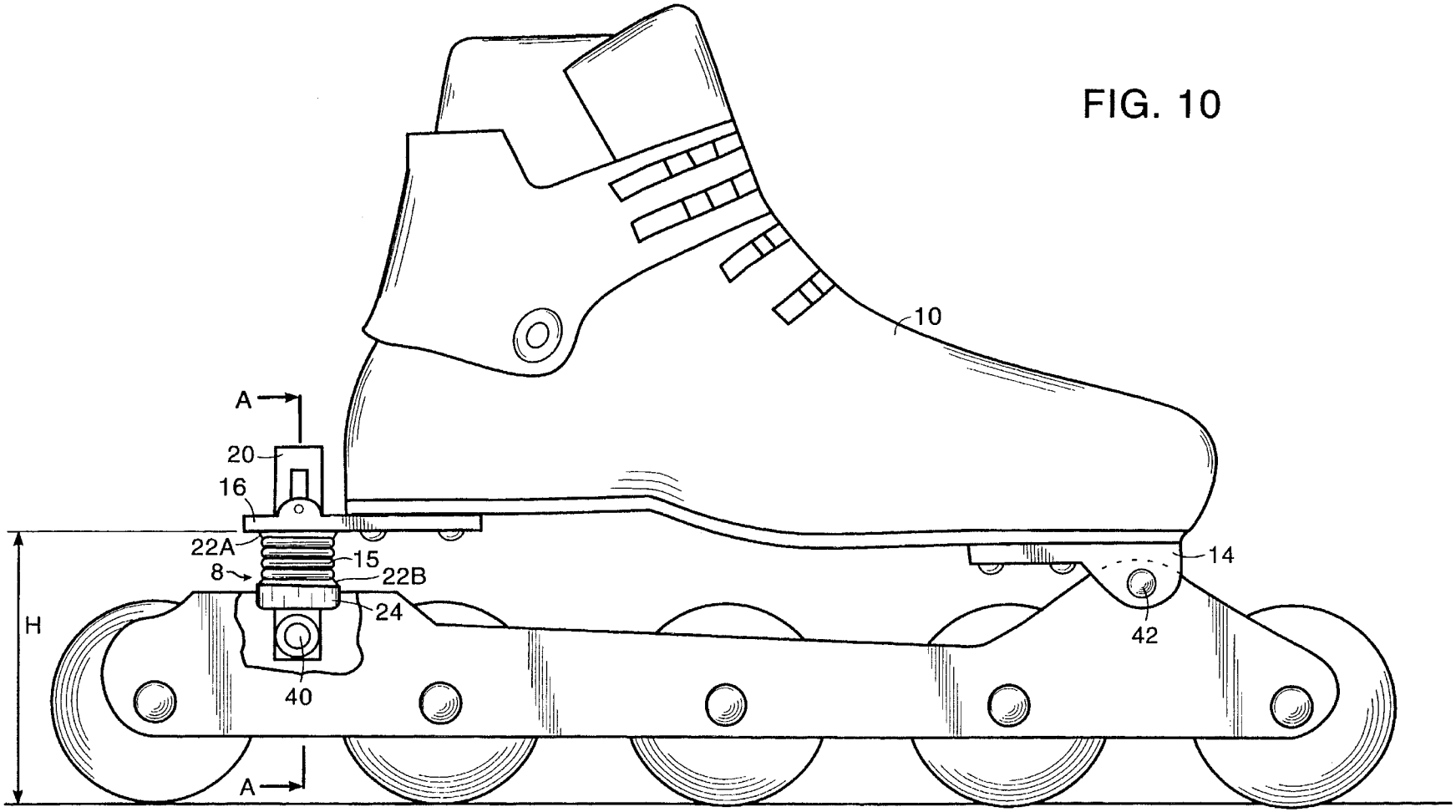
FIG. 10 shows a side view of the skate according to the invention during use under normal conditions with the partially broken wheel frame.

FIG. 10 shows the condition of the in-line skate during normal operation when a downwardly directed load (i.e. the weight of the skater) is applied to the top of an in-line skate. It should be noted that spring 15 is partially compressed, extended pin 20 has moved rearwardly away from a shoe 10 and the vertical distance H has decreased.

The suspension system 8 will adjust variations in load when the skater transfers part of his/her weight from one foot to another. When the skater transfers his/her weight, the spring 15 will be compressed while resilient bottom and top cavity washers 22*a*, 22*b* will prevent the spring from sliding to the sides, the extended pin 20 of the centering finger 24 penetrates into the centering bore 38 (FIG. 3) of the heel attachment 16 and slightly moves rearwardly permitting a full compression of the spring 15. A bar pin 37 will help adjust the extended pin 20 through the cut in the pin 36 (FIG. 2).

According to the invention, the rear axle 40 will permit rearward movement of the centering finger 24 while skater is in operation. Pivoting axle 42 of toe attachment 14 will allow spring 15 to make all accomodate variations in load when skater transfers his/her weight.

A skater usually operates keeping skates under slight angle inside, Therefore heel attachment 16, centering barrel 19 of the toe attachment prevent a wheel frame 44 with wheels from bending. The toe flange members 30 that overlap wheel frame flanges 28*a*, 28*b* and centering barrel 19 do not allow a wheel frame 44 to bend in relation to the shoe 10. FIGS. 4, 5, 6.

I claim:

1. An in-line roller skate comprising:

a boot with a heel and toe plate, the heel plate extending behind the heel of the boot, and comprising two raised flanges and a centering bore, a wheel frame, with two vertical side members and a plurality of wheels connected in between the side members, pivotally connected to the front toe plate, and a suspension system comprising a pivoting axle connected between the two side members, a hollow pin with a vertical slot pivotally connected to the pivoting axle and extending above the heel plate through the centering bore, a resilient member connected to the heel plate and the wheel frame, and a bar pin that extends through the raised flanges of the heel plate and also through the vertical slot of the hollow pin, the system working so that when a force is pressed on the heel the resilient member contracts and the hollow pin extends further through the centering bore.

2. In-line roller skates of claim 1 wherein skates are characterized in that a pivoting axle, a centering finger, and an extended pin are made as a single joined unit.

3. In-line roller skates of claim 2 wherein skates are characterized in that the pivoting axle, the centering finger and the extended pin are hollow and are made of titanium, aluminum or a strong and rigid plastic component.

4. In-line roller skates of claim 1 wherein skates are characterized in that a suspension system comprising of a spring is contracted by a heel plate.

5. In-line roller skates of claim 1 wherein skates are characterized in that cylindrically shaped centering washers are located between the side members of the wheel frame with a centering finger between them.

6. In-line roller skates of claim 1 wherein skates are characterized in that a heel plate has an oblong shaped centering bore.

7. In-line roller skates of claim 1 is characterized in that two raised flanges are used to secure a bar pin.

8. In-line roller skates of claim 1 wherein skates comprising of a combination of a suspension system and toe and heel attachments that allow vertical movement of a boot.

* * * * *